US012188656B2

(12) United States Patent
Kawabe et al.

(10) Patent No.: US 12,188,656 B2
(45) Date of Patent: Jan. 7, 2025

(54) CORRELATION DERIVING METHOD AND CORRELATION DERIVING DEVICE

(71) Applicants: IHI Corporation, Tokyo (JP); IHI INSPECTION AND INSTRUMENTATION CO., LTD., Tokyo (JP)

(72) Inventors: Hirotaka Kawabe, Tokyo (JP); Kenjiro Chie, Tokyo (JP); Junichi Shigeta, Tokyo (JP)

(73) Assignees: IHI Corporation, Tokyo (JP); IHI INSPECTION AND INSTRUMENTATION CO., LTD., Tokyo (JP)

( * ) Notice: Subject to any disclaimer, the term of this patent is extended or adjusted under 35 U.S.C. 154(b) by 241 days.

(21) Appl. No.: 17/816,445

(22) Filed: Aug. 1, 2022

(65) Prior Publication Data

US 2022/0364722 A1 Nov. 17, 2022

Related U.S. Application Data

(63) Continuation of application No. PCT/JP2020/008712, filed on Mar. 2, 2020.

(51) Int. Cl.
*F28F 19/00* (2006.01)
*F22B 37/38* (2006.01)
(Continued)

(52) U.S. Cl.
CPC ..... *F22B 37/38* (2013.01); *F23N 5/022* (2013.01); *F23N 5/265* (2013.01); *F23N 2225/21* (2020.01); *F23N 2239/02* (2020.01)

(58) Field of Classification Search
CPC ..... F22B 37/38; F23N 5/022; F23N 5/265; F23N 2239/02; F23N 2225/21
(Continued)

(56) References Cited

U.S. PATENT DOCUMENTS

2011/0070549 A1* 3/2011 Moreno Rueda ..... F23J 1/06 431/115
2012/0174836 A1 7/2012 Akiyama et al.
(Continued)

FOREIGN PATENT DOCUMENTS

CN 1628226 A 6/2005
JP 2004-361368 A 12/2004
(Continued)

OTHER PUBLICATIONS

Taiwanese Office Action issued Apr. 26, 2023 in Taiwanese Application 109106779, 4 pages.
(Continued)

*Primary Examiner* — Davis D Hwu
(74) *Attorney, Agent, or Firm* — Oblon, McClelland, Maier & Neustadt, L.L.P.

(57) ABSTRACT

Provided is a correlation deriving method including the steps of: generating coal ash by incinerating coal; generating sintered ash by heating the coal ash at a predetermined heating temperature within a range of a combustion temperature of a coal burning boiler; measuring hardness of the sintered ash; measuring an exhaust gas temperature exhibited when coal which is to have the hardness is burnt in the coal burning boiler; and deriving a correlation between the hardness and the exhaust gas temperature.

2 Claims, 8 Drawing Sheets

(51) Int. Cl.
*F23N 5/02* (2006.01)
*F23N 5/26* (2006.01)

(58) Field of Classification Search
USPC ..... 165/11.1
See application file for complete search history.

(56) References Cited

U.S. PATENT DOCUMENTS

| | | | |
|---|---|---|---|
| 2018/0073724 | A1 | 3/2018 | Kim et al. |
| 2021/0156561 | A1 | 5/2021 | Kawabe et al. |

FOREIGN PATENT DOCUMENTS

| | | | | |
|---|---|---|---|---|
| JP | 4244713 | B2 | | 3/2009 |
| JP | 2011-080727 | A | | 4/2011 |
| JP | 2011-226756 | A | | 11/2011 |
| JP | 2012-013252 | A | | 1/2012 |
| JP | 2012-013253 | A | | 1/2012 |
| JP | 2016-205681 | A | | 12/2016 |
| JP | 2017-080727 | A | | 5/2017 |
| JP | 2019138517 | A | * | 8/2019 |
| JP | 2020-038020 | A | | 3/2020 |
| JP | 2020-153714 | A | | 9/2020 |
| KR | 10-1847743 | B1 | | 5/2018 |
| WO | WO 2011/043351 | A1 | | 4/2011 |
| WO | WO 2020/050050 | A1 | | 3/2020 |
| WO | WO 2021/187103 | A1 | | 9/2021 |

OTHER PUBLICATIONS

Japanese Notice of Allowance issued May 9, 2023 in Japanese Application 2022-504784, 3 pages.
International Search Report issued May 26, 2020 in PCT/JP2020/008712 filed on Mar. 2, 2020, 4 pages (with English Translation).
International Search Report issued Oct. 21, 2019 in PCT/JP2019/032868, 4 pages (with English Translation).
Australian Office Action issued Feb. 22, 2022 in Australian Patent Application No. 2019334630, 3 pages.
Japanese Decision to Grant issued May 10, 2022 in Japanese Patent Application No. 2018-164614, 3 pages.
Couch, "Understanding slagging and fouling in pf combustion", IEA Coal Research, IEACR/72, 1994, 121 pages.

* cited by examiner

CORRELATION DERIVING METHOD AND CORRELATION DERIVING DEVICE

CROSS REFERENCE TO RELATED APPLICATIONS

This application is a continuation application of International Application No. PCT/JP2020/008712, filed on Mar. 2, 2020, the entire contents of which are incorporated by reference herein.

BACKGROUND ART

Technical Field

The present disclosure relates to a correlation deriving method and a correlation deriving device.

Related Art

In general, in a coal burning boiler, molten ash is generated in combustion gas due to the combustion of pulverized coal. Because of this, there occur troubles, such as so-called slagging and fouling, in which ash adheres to and is deposited on a furnace wall and heat transfer tubes in a main body of the coal burning boiler. When such adhesion and deposition of the ash occur, there is a risk in that heat recovery on a heat transfer surface by the furnace wall and the heat transfer tubes is significantly reduced. In addition, when a huge clinker is laminated on the surface of the furnace wall, defects, such as a large fluctuation in internal pressure of a furnace and clogging of a furnace bottom, occur due to the fall of the clinker.

In particular, an upper heat transfer unit including a secondary superheater, a tertiary superheater, a final superheater, and a secondary reheater provided in an upper portion of the furnace has structure in which combustion gas flows between the heat transfer tubes arranged at narrow intervals to perform heat exchange. Because of this, when the ash adheres to the upper heat transfer unit, the internal pressure of the furnace is greatly fluctuated and a gas flow path is closed, with the result that the operation of the coal burning boiler is forced to be stopped.

Thus, in order to stably operate the coal burning boiler, it is required to estimate in advance the possibility of ash adhesion during combustion of coal fuel.

For the above-mentioned reason, an attempt has hitherto been made to express the possibility of the occurrence of ash adhesion as an indicator, and the indicator and evaluation criteria regarding ash based on an ash composition in which an ash-containing element is represented by an oxide have been generally used (see, for example, Non Patent Literature 1).

The indicator and evaluation criteria regarding ash as described in Non Patent Literature 1 are determined for bituminous coal, which is high-quality coal having few problems such as ash adhesion.

However, the relationship between the indicator as described in Non Patent Literature 1 and the ash adhesion does not always tend to be satisfied, and hence it has been pointed out that the indicator does not have high reliability. Accordingly, in the above-mentioned related-art indicator, there has been a problem in that, for example, subbituminous coal, high silica coal, high S coal, high calcium coal, high ash coal, and the like, which are regarded as low-quality coal, cannot be used depending on the kind of coal. In addition, ash failure occurred in some cases when coal which was considered to have no problems based on the related-art indicator was used.

Meanwhile, in recent years, there has been an increasing demand for the use of low-quality coal from the viewpoints of difficulty in stable availability of high-quality coal caused by reduction in production amount thereof, economy, and the like. For this reason, there has been a need for a new indicator regarding ash adhesion that is also adaptable to ash generated by the combustion of those low-quality coals.

In view of the above-mentioned requirement, there is disclosed evaluation of ash adhesion characteristics based on a slag viscosity at a predetermined atmospheric temperature when various kinds of solid fuels including low-quality coal are mixed (see, for example, Patent Literature 1).

CITATION LIST

Patent Literature

Patent Literature 1: JP 2011-80727 A

Non Patent Literature

Non Patent Literature 1: Understanding slagging and fouling in pf combustion (IEACR/72), 1994

SUMMARY

Technical Problem

However, as disclosed in Patent Literature 1, regarding low-quality coal such as subbituminous coal on which few findings have been accumulated, it is difficult to accurately grasp the adhesion behavior of slag in an actual boiler from a numerical value obtained by calculating a slag viscosity based on a chemical composition and the like. Further, it is considered to be difficult in actuality to measure and calculate a slag viscosity by heating a solid fuel such as coal at an atmospheric temperature that may become a high temperature (e.g., 1,300° C.). In view of the foregoing, the development of a new indicator regarding ash is being sought for.

In view of the above-mentioned problems, the present disclosure has an object to provide a correlation deriving method and a correlation deriving device which are capable of deriving a new indicator regarding ash.

Solution to Problem

In order to solve the above-mentioned problems, according to one aspect of the present disclosure, there is provided a correlation deriving method including the steps of: generating coal ash by incinerating coal; generating sintered ash by heating the coal ash at a predetermined heating temperature within a range of a combustion temperature of a coal burning boiler; measuring hardness of the sintered ash; measuring an exhaust gas temperature exhibited when coal which is to have the hardness is burnt in the coal burning boiler; and deriving a correlation between the hardness and the exhaust gas temperature.

In order to solve the above-mentioned problems, according to another aspect of the present disclosure, there is provided a correlation deriving device including a correlation deriving module configured to derive a correlation between: hardness of sintered ash obtained by heating coal ash at a predetermined heating temperature within a range of a combustion temperature of a coal burning boiler; and an exhaust gas temperature exhibited when coal which is to have the hardness is burnt in the coal burning boiler.

Effects of Disclosure

According to present disclosure, the new indicator regarding ash can be derived.

DESCRIPTION OF EMBODIMENTS

Figure 1:
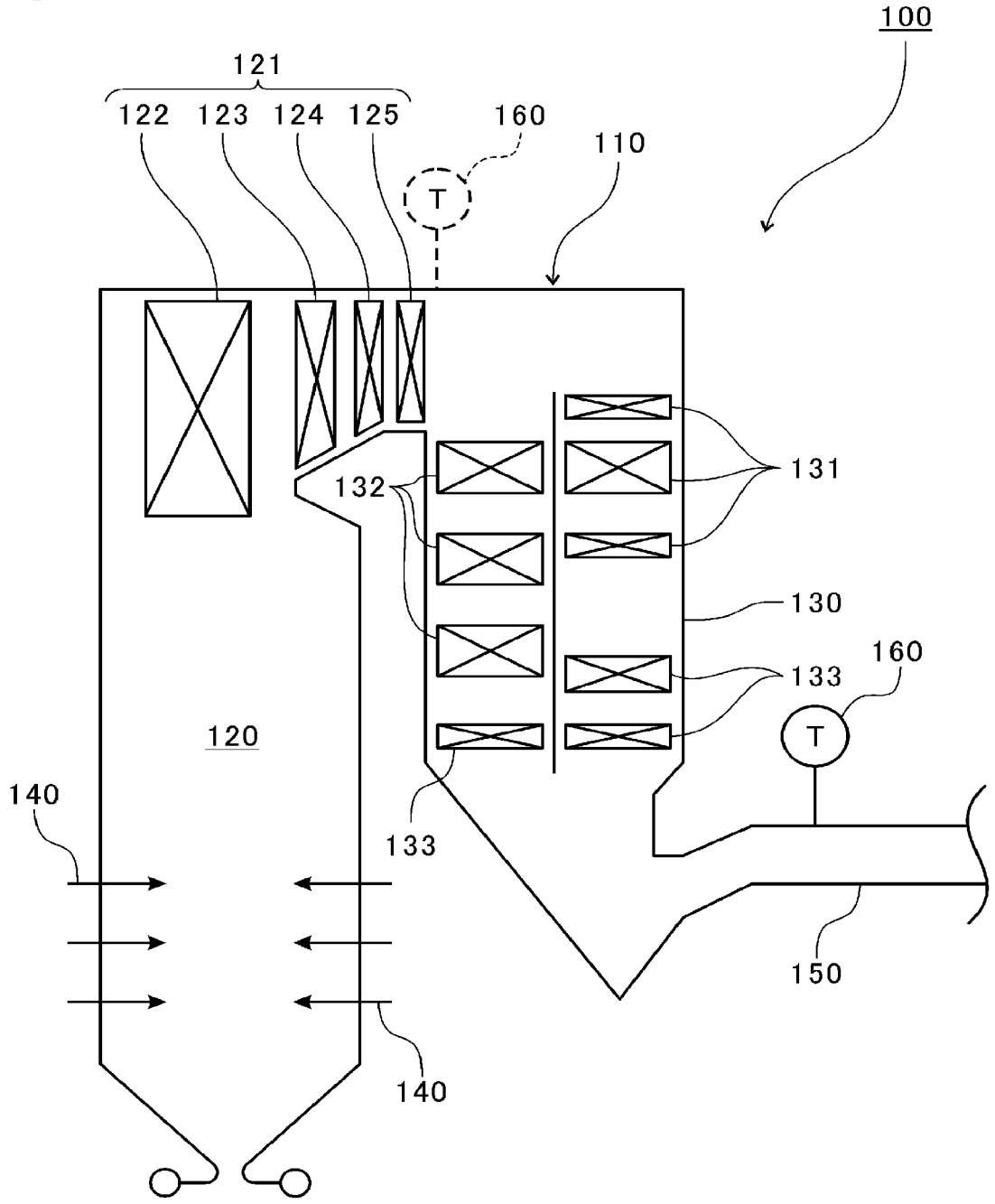
FIG. 1 is a side sectional view for illustrating an example of a coal burning boiler.

Now, with reference to the attached drawings, embodiments of the present disclosure are described in detail. The dimensions, materials, and other specific numerical values represented in the embodiments are merely examples used for facilitating the understanding of the disclosure, and do not limit the present disclosure otherwise particularly noted. Elements having substantially the same functions and configurations herein and in the drawings are denoted by the same reference symbols to omit redundant description thereof. Further, illustration of elements with no direct relationship to the present disclosure is omitted.

First Embodiment

[Coal Burning Boiler 100]

First, an example of a coal burning boiler to which a correlation deriving device and a correlation deriving method according to a first embodiment of the present disclosure are applied is schematically described with reference to FIG. 1. FIG. 1 is a side sectional view for illustrating an example of a coal burning boiler 100.

As illustrated in FIG. 1, the coal burning boiler 100 includes a boiler main body 110. The boiler main body 110 includes a furnace 120 and a rear heat transfer unit 130. The furnace 120 is formed of furnace wall tubes (heat transfer tubes). Burners 140 are arranged in a lower portion of the furnace 120 of the boiler main body 110. The burners 140 each inject and burn pulverized coal fuel. An upper heat transfer unit 121 is installed in an upper portion of the furnace 120 of the boiler main body 110. The upper heat transfer unit 121 includes a secondary superheater 122, a tertiary superheater 123, a final superheater 124, and a secondary repeater 125. Primary superheaters 131, primary repeaters 132, and economizers 133 are installed in the rear heat transfer unit 130 of the boiler main body 110. Those heat exchangers are each formed of a heat transfer tube.

Then, when the pulverized coal fuel is injected from the burners 140 into the furnace 120 of the boiler main body 110 and burnt, the combustion gas heats the heat transfer tubes forming the furnace wall of the furnace 120. Then, after heating the heat transfer tubes forming the furnace wall of the furnace 120, the combustion gas heats the upper heat transfer unit 121 including the secondary superheater 122, the tertiary superheater 123, the final superheater 124, and the secondary reheater 125 in the upper portion of the furnace 120. Subsequently, the combustion gas heats the primary superheaters 131, the primary repeaters 132, and the economizers 133 of the rear heat transfer unit 130. The combustion gas (exhaust gas), which has been subjected to heat exchange and deprived of heat, is led to a boiler outlet exhaust gas duct 150. The exhaust gas guided to the boiler outlet exhaust gas duct 150 has a nitrogen oxide, a sulfur oxide, and the like removed therefrom by a device for flue gas treatment (not shown), such as denitration and desulfurization, which is provided on a downstream side, and is subjected to dust removal by a dust collector (not shown). After that, the exhaust gas is released to the atmosphere.

A temperature detector 160 is provided at the boiler outlet exhaust gas duct 150. The temperature detector 160 measures the temperature of the exhaust gas passing through the boiler outlet exhaust gas duct 150. The temperature detector 160 may be provided in an outlet portion of the furnace 120 as indicated by the broken line in FIG. 1. That is, the temperature detector 160 may measure the temperature of the exhaust gas which has passed through the upper heat transfer unit 121 (secondary superheater 122, tertiary superheater 123, final superheater 124, and secondary reheater 125).

[Coal Burning Boiler Ash Adhesion Estimation Device 200]

Figure 2:
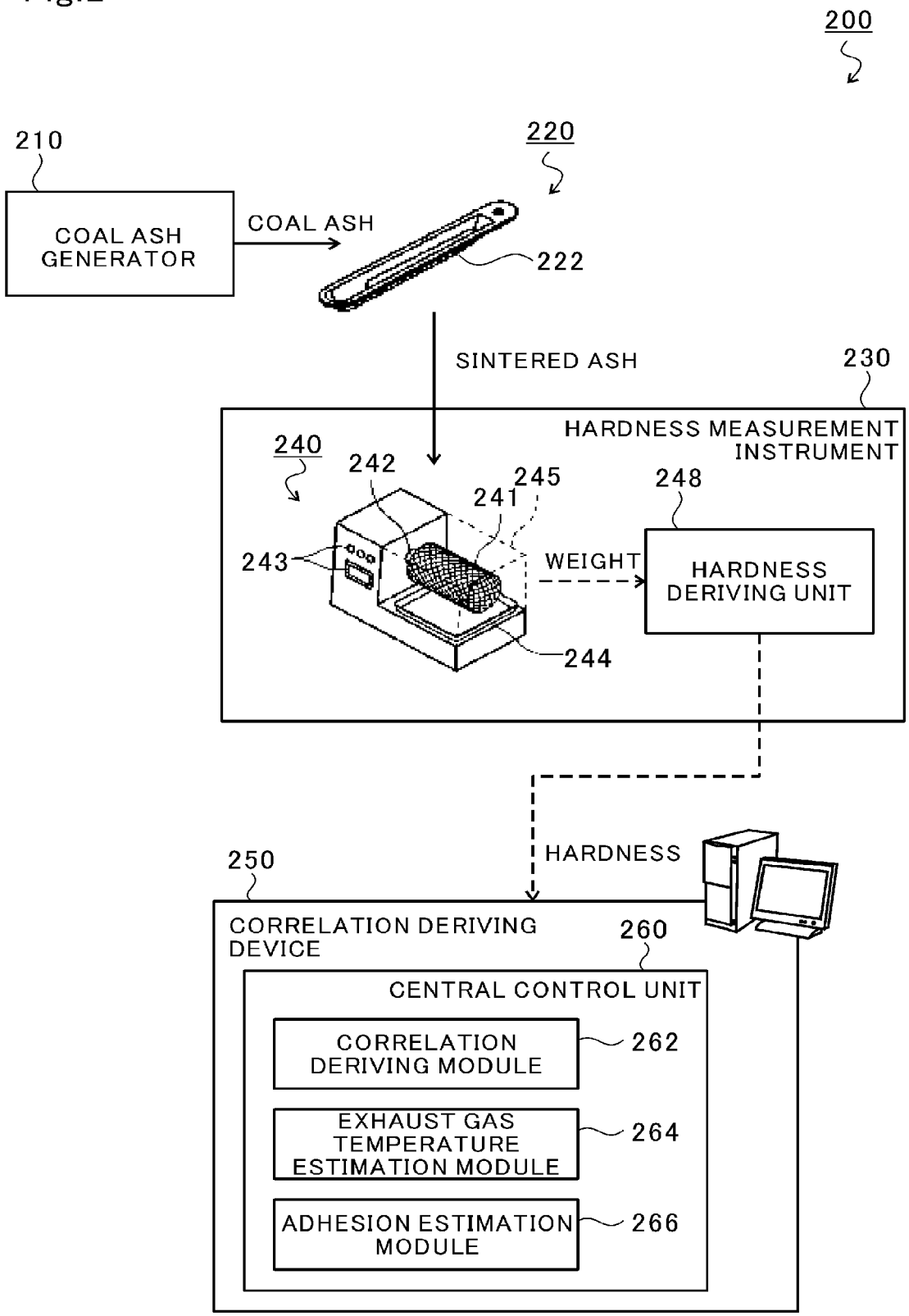
FIG. 2 is a diagram for illustrating a coal burning boiler ash adhesion estimation device in a first embodiment of the present disclosure.

FIG. 2 is a diagram for illustrating a coal burning boiler ash adhesion estimation device 200 in the first embodiment. As illustrated in FIG. 2, the coal burning boiler ash adhesion estimation device 200 includes a coal ash generator 210, a sintered ash generator 220, a hardness measurement instrument 230, and a correlation deriving device 250.

The coal ash generator 210 generates coal ash by incinerating coal to be adopted as fuel in the coal burning boiler 100 (see FIG. 1). The coal ash generator 210 incinerates the coal at 815° C. in accordance with, for example, the JIS method.

The sintered ash generator 220 generates sintered ash by heating the coal ash generated by the coal ash generator 210 at a predetermined heating temperature within a range of the combustion temperature of the coal burning boiler 100. In this embodiment, the sintered ash generator 220 includes a magnetic boat 222. The coal ash is supplied to the magnetic boat 222. The coal ash supplied to the magnetic boat 222 is heated at a predetermined heating temperature by a heating device (not shown).

The above-mentioned heating temperature is a temperature that can cover at least the temperature in the vicinity of the upper heat transfer unit 121 of the coal burning boiler 100, and is, for example, a temperature within a temperature range of 900° C. or more and 1,400° C. or less (preferably a temperature range of 900° C. or more and 1,200° C. or less).

The hardness measurement instrument 230 measures the hardness of the sintered ash generated by the sintered ash generator 220. The hardness measurement instrument 230 is, for example, a device for measuring compressive strength, a device for measuring Vickers hardness, or a device including a rattler tester. Here, a case in which the hardness measurement instrument 230 is a device including a rattler tester 240 is given as an example. The hardness measurement instrument 230 includes the rattler tester 240 and a hardness deriving unit 248.

The rattler tester 240 is used for evaluation of a sintered metal. The rattler tester 240 includes a cylindrical wire mesh 241, a rotary shaft 242, a setting unit 243, a passing object tray 244, and a cover 245. The cylindrical wire mesh 241 is a cylindrical wire mesh (mesh size: 1 mm #) having a diameter of about 100 mm and a length of about 120 mm. The rotary shaft 242 connects a motor (not shown) and the cylindrical wire mesh 241 to each other. The motor rotates the cylindrical wire mesh 241 via the rotary shaft 242 at, for example, 80 rpm. The setting unit 243 sets the rotation speed of the cylindrical wire mesh 241. The passing object tray 244 is provided below the cylindrical wire mesh 241. The cover 245 covers the cylindrical wire mesh 241 and the passing object tray 244.

In the rattler tester 240, first, the sintered ash is accommodated inside the cylindrical wire mesh 241. Then, the motor rotates the cylindrical wire mesh 241 at a constant rotation speed set by the setting unit 243. Particles of the sintered ash that are separated from the sintered ash during rotation and fall through meshes of the cylindrical wire mesh 241 are received by the passing object tray 244. Then, the weight of the sintered ash before a test (before rotation) and the weight of the sintered ash after the test (after rotation) are output to the hardness deriving unit 248.

The hardness deriving unit 248 is formed of a semiconductor integrated circuit including a central processing unit (CPU). The hardness deriving unit 248 reads out a program, parameters, and the like for operating the CPU itself from a ROM. The hardness deriving unit 248 manages and controls the entire hardness measurement instrument 230 in cooperation with a RAM serving as a work area and other electronic circuits.

The hardness deriving unit 248 derives the hardness of the sintered ash based on the weight ratio of the sintered ash before and after the rotational separation. In this embodiment, the hardness deriving unit 248 defines a value obtained by dividing the weight of the sintered ash after the test by the weight of the sintered ash before the test ((hardness)=(weight of sintered ash after test)/(weight of sintered ash before test)) as the hardness.

The correlation deriving device 250 includes a central control unit 260. The central control unit 260 is formed of a semiconductor integrated circuit including a central processing unit (CPU). The central control unit 260 reads out a program, parameters, and the like for operating the CPU itself from a ROM. The central control unit 260 manages and controls the entire correlation deriving device 250 in cooperation with a RAM serving as a work area and other electronic circuits.

In this embodiment, the central control unit 260 functions as a correlation deriving module 262, an exhaust gas temperature estimation module 264, and an adhesion estimation module 266.

The correlation deriving module 262 derives a correlation between the hardness measured by the hardness measurement instrument 230 and the exhaust gas temperature measured by the temperature detector 160. The temperature detector 160 measures the temperature of the exhaust gas exhibited when coal which is to have the hardness measured by the hardness measurement instrument 230 is burnt in the coal burning boiler 100. The correlation between the hardness and the exhaust gas temperature is described later in detail.

The exhaust gas temperature estimation module 264 refers to the correlation between the hardness and the exhaust gas temperature derived by the correlation deriving module 262, and derives an estimation value of the exhaust gas temperature from the hardness of the coal to be adopted as fuel. The hardness of the coal to be adopted as fuel is measured by the hardness measurement instrument 230.

The adhesion estimation module 266 estimates ash adhesion to the heat transfer tubes in the coal burning boiler 100 based on the estimation value of the exhaust gas temperature derived by the exhaust gas temperature estimation module 264. The adhesion estimation module 266 determines that, as the estimation value of the exhaust gas temperature becomes higher, the possibility of ash adhesion to the heat transfer tubes becomes higher. For example, the adhesion estimation module 266 displays the estimated adhesion state of the ash to the heat transfer tubes on a screen or calls attention by voice.

[Coal Burning Boiler Ash Adhesion Estimation Method]

Figure 3:
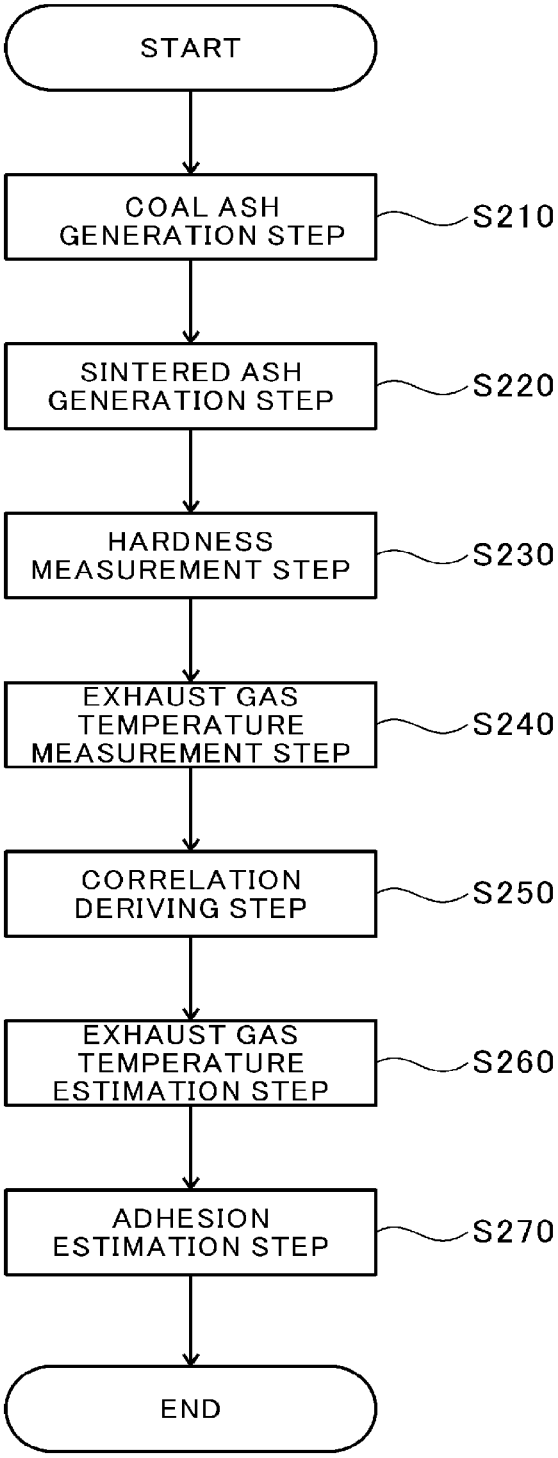
FIG. 3 is a flowchart for illustrating a flow of processing of a coal burning boiler ash adhesion estimation method in the first embodiment.

Next, a coal burning boiler ash adhesion estimation method using the coal burning boiler ash adhesion estimation device 200 is described. FIG. 3 is a flowchart for illustrating a flow of processing of the coal burning boiler ash adhesion estimation method in the first embodiment. As illustrated in FIG. 3, the coal burning boiler ash adhesion estimation method in the first embodiment includes a coal ash generation step S210, a sintered ash generation step S220, a hardness measurement step S230, an exhaust gas temperature measurement step S240, a correlation deriving step S250, an exhaust gas temperature estimation step S260, and an adhesion estimation step S270. Now, each of the steps is described in detail.

[Coal Ash Generation Step S210]

The coal ash generation step S210 is a step in which the coal ash generator 210 generates coal ash by incinerating the coal to be adopted as fuel in the coal burning boiler 100 (see FIG. 1). The coal is, for example, a plurality of kinds of coals, such as high-quality coal and low-quality coal. The plurality of kinds of coals are each incinerated at 815° C. in accordance with the JIS method. As a result, a plurality of coal ashes are generated from the plurality of kinds of coals, respectively.

[Sintered Ash Generation Step S220]

The sintered ash generation step S220 is a step in which the sintered ash generator 220 heats the coal ashes generated in the coal ash generation step S210 at heating temperatures at a plurality of points within a range of the combustion temperature of the coal burning boiler 100, to thereby generate sintered ash at each of the heating temperatures. The heating temperatures at the plurality of points are temperatures that can cover at least the temperature in the vicinity of the upper heat transfer unit 121 of the coal burning boiler 100, and are, for example, temperatures at a plurality of points (for example, temperatures at a plurality of points at temperature intervals of 50° C.) within a temperature range of 900° C. or more and 1,400° C. or less (preferably, a temperature range of 900° C. or more and 1,200° C. or less).

[Hardness Measurement Step S230]

The hardness measurement step S230 is a step in which the hardness measurement instrument 230 measures the hardness of each of the sintered ashes generated in the sintered ash generation step S220. In the hardness measurement step S230, first, the weight of the sintered ash before the test (before rotation) and the weight of the sintered ash after the test (after rotation) are measured by the rattler tester 240, and the measurement values are output to the hardness deriving unit 248.

Then, the hardness deriving unit 248 derives the hardness of the sintered ash based on the weight ratio of the sintered ash before and after the rotational separation.

[Exhaust Gas Temperature Measurement Step S240]

The exhaust gas temperature measurement step S240 is a step in which the temperature detector 160 (see FIG. 1) measures an exhaust gas temperature exhibited when coal which is to have the hardness measured in the hardness measurement step S230 is burnt in the coal burning boiler 100.

[Correlation Deriving Step S250]

The correlation deriving step S250 is a step in which the correlation deriving module 262 of the correlation deriving device 250 derives a correlation between the hardness measured in the hardness measurement step S230 and the exhaust gas temperature measured in the exhaust gas temperature measurement step S240.

Figure 4:
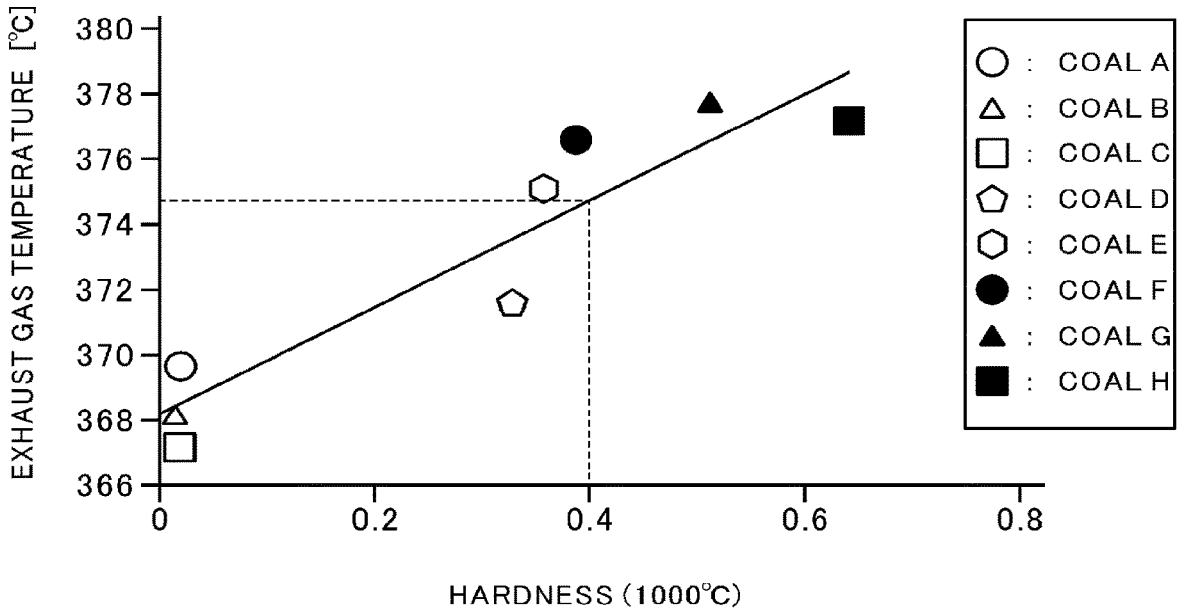
FIG. 4 is a graph for showing a correlation between hardness and an exhaust gas temperature.

FIG. 4 is a graph for showing a correlation between hardness and an exhaust gas temperature. In FIG. 4, the vertical axis represents an exhaust gas temperature [° C.]. In FIG. 4, the horizontal axis represents hardness. In FIG. 4, a case in which the heating temperature (sintering temperature) in the sintered ash generation step S220 is 1,000° C. is given as an example.

It has been clarified by the studies of the inventors of the present application that, when the correlation between the hardness and the exhaust gas temperature is shown regarding coal A to coal H including bituminous coal, which is high-quality coal, subbituminous coal, which is low-quality coal, and the like, the correlation as in a graph shown in FIG. 4 is obtained. That is, as the hardness becomes larger (as the sintered ash becomes harder), the exhaust gas temperature becomes higher.

In the correlation deriving step S250, the correlation deriving module 262 derives a correlation between hardness and an exhaust gas temperature for each sintering temperature. The plurality of correlations derived in the correlation deriving step S250 are held in a memory (not shown) of the correlation deriving device 250.

[Exhaust Gas Temperature Estimation Step S260]

The exhaust gas temperature estimation step S260 and the adhesion estimation step S270 described later are performed at timing different from that of the coal ash generation step S210 to the correlation deriving step S250. For example, the coal ash generation step S210 to the correlation deriving step S250 are performed before the operation of the coal burning boiler 100, and the exhaust gas temperature estimation step S260 and the adhesion estimation step S270 described later are performed during the operation of the coal burning boiler 100.

The exhaust gas temperature estimation step S260 is a step in which the exhaust gas temperature estimation module 264 of the correlation deriving device 250 derives an estimation value of the exhaust gas temperature from the hardness of the coal to be adopted as fuel based on the correlation between the hardness and the exhaust gas temperature held in the memory. In the exhaust gas temperature estimation step S260, the hardness of the coal to be adopted as fuel is derived by the coal ash generator 210, the sintered ash generator 220, and the hardness measurement instrument 230. For example, when the derived hardness is 0.4, the exhaust gas temperature is estimated to be 374° C. or more and 375° C. or less with reference to the graph shown in FIG. 4.

[Adhesion Estimation Step S270]

The adhesion estimation step S270 is a step in which the adhesion estimation module 266 estimates ash adhesion to the heat transfer tubes in the coal burning boiler 100 based on the estimation value of the exhaust gas temperature derived in the exhaust gas temperature estimation step S260. The adhesion estimation module 266 determines that, as the estimation value of the exhaust gas temperature becomes higher, the possibility of ash adhesion to the heat transfer tubes becomes higher.

As described above, the coal burning boiler ash adhesion estimation device 200 and the coal burning boiler ash adhesion estimation method using the same in this embodiment derive a correlation between hardness and an exhaust gas temperature, which is a new indicator regarding ash. The high exhaust gas temperature means that the ash adheres to the heat transfer tubes to hinder the heat exchange with the exhaust gas in the heat transfer tubes. That is, in the coal burning boiler 100, when coal having a high exhaust gas temperature is used as fuel, there is a risk in that that clogging trouble caused by ash adhesion occurs. The coal burning boiler ash adhesion estimation device 200 in this embodiment measures the hardness as a coal property parameter and creates a correlation between the hardness and the exhaust gas temperature as the graph shown in FIG. 4, thereby being capable of estimating the exhaust gas temperature from the hardness. As a result, the coal burning boiler ash adhesion estimation device 200 can estimate ash failure based on the estimation value of the exhaust gas temperature.

That is, when the correlation deriving module 262 derives the correlation between the hardness and the exhaust gas temperature in the correlation deriving step S250 as the graph shown in FIG. 4, the exhaust gas temperature can be estimated merely by measuring the hardness of the coal to be adopted as fuel. Because of this, the coal burning boiler ash adhesion estimation device 200 can estimate ash adhesion to the heat transfer tubes in the coal burning boiler 100 based on the estimation value of the exhaust gas temperature. In this case, it is not required to stop the operation of the coal burning boiler 100.

In addition, the coal burning boiler ash adhesion estimation device 200 can avoid, for example, the situation in which the actual slag viscosity is calculated at an atmospheric temperature that may become as extremely high as 1,300° C., as in the related art disclosed in Patent Literature 1. Because of this, the coal burning boiler ash adhesion estimation device 200 is effective for stably operating the actual coal burning boiler 100.

As described above, the coal burning boiler ash adhesion estimation device 200 and the coal burning boiler ash adhesion estimation method can suppress a decrease in operating rate of the coal burning boiler 100 caused by ash failure and effectively utilize economical low-quality coal by grasping the correlation between the hardness and the exhaust gas temperature.

Second Embodiment: Coal Burning Boiler Ash Adhesion Prevention Device 300

Figure 5:
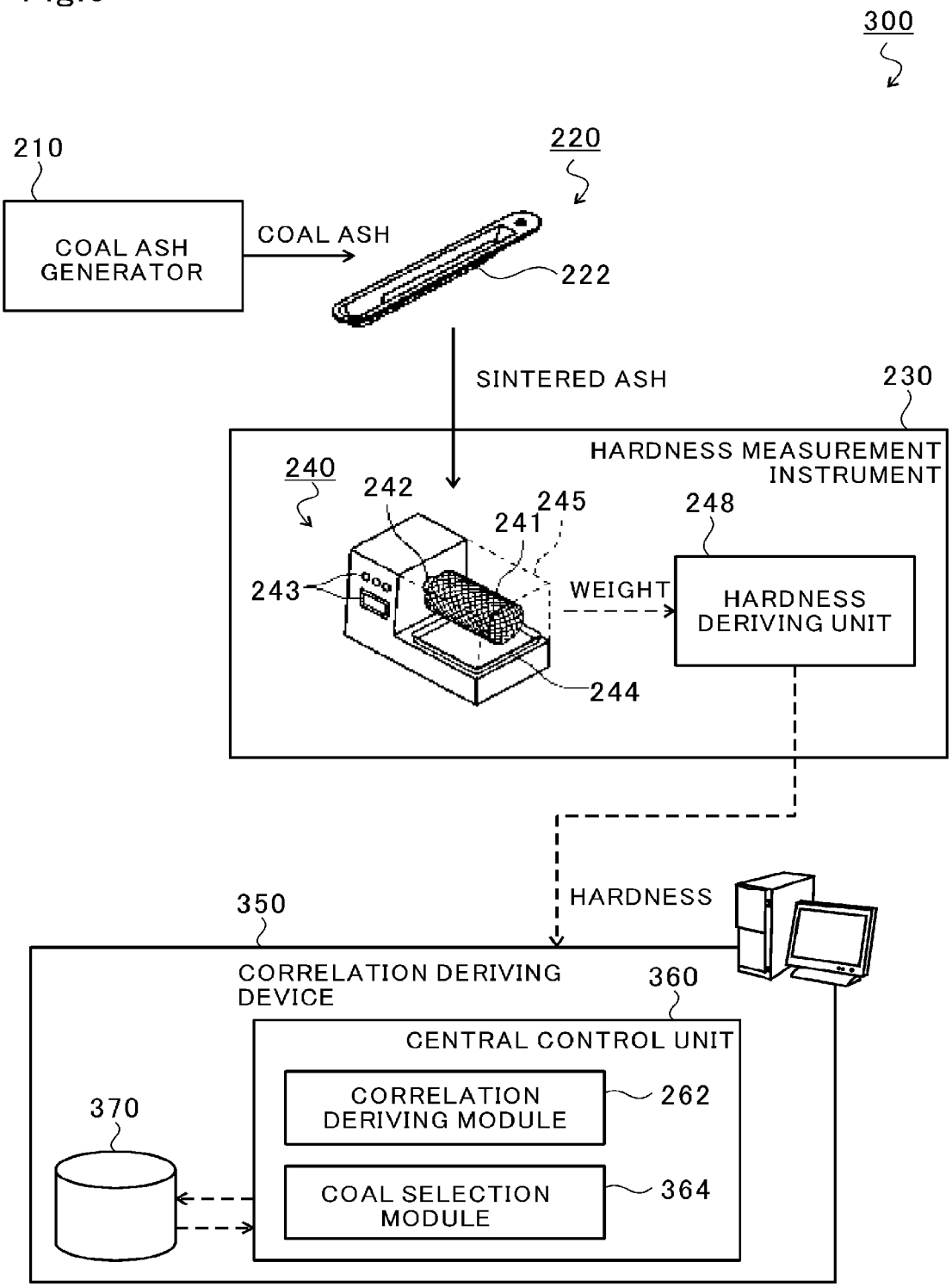
FIG. 5 is a diagram for illustrating a coal burning boiler ash adhesion prevention device in a second embodiment of the present disclosure.

FIG. 5 is a diagram for illustrating a coal burning boiler ash adhesion prevention device 300 in a second embodiment of the present disclosure. As illustrated in FIG. 5, the coal burning boiler ash adhesion prevention device 300 includes the coal ash generator 210, the sintered ash generator 220, the hardness measurement instrument 230, and a correlation deriving device 350. The components that are substantially the same as those of the coal burning boiler ash adhesion estimation device 200 are denoted by the same reference symbols, and the description thereof is omitted.

The correlation deriving device 350 includes a central control unit 360 and a memory 370. The central control unit 360 is formed of a semiconductor integrated circuit including a central processing unit (CPU). The central control unit 360 reads out a program, parameters, and the like for operating the CPU itself from a ROM. The central control unit 360 manages and controls the entire correlation deriving device 350 in cooperation with a RAM serving as a work area and other electronic circuits.

The memory 370 is formed of a ROM, a RAM, a flash memory, an HDD, and the like, and stores programs and various data to be used in the central control unit 360. In this embodiment, the memory 370 stores hardness data. The hardness data is information indicating any one or both of the hardness of a single kind of coal and the hardness of a mixture of a plurality of kinds of coals.

In this embodiment, the central control unit 360 functions as the correlation deriving module 262 and a coal selection module 364.

The coal selection module 364 selects, as fuel, coal having hardness at which the estimation value of the exhaust gas temperature becomes a set value or less with reference to the hardness data stored in the memory 370 based on the correlation between the hardness and the exhaust gas temperature derived by the correlation deriving module 262. The coal to be selected is a single kind of coal or a mixture of a plurality of kinds of coals. The set value of the exhaust gas temperature is, for example, from about 374° C. to about 376° C. However, the set value of the exhaust gas temperature is not limited.

[Coal Burning Boiler Ash Adhesion Prevention Method]

Figure 6:
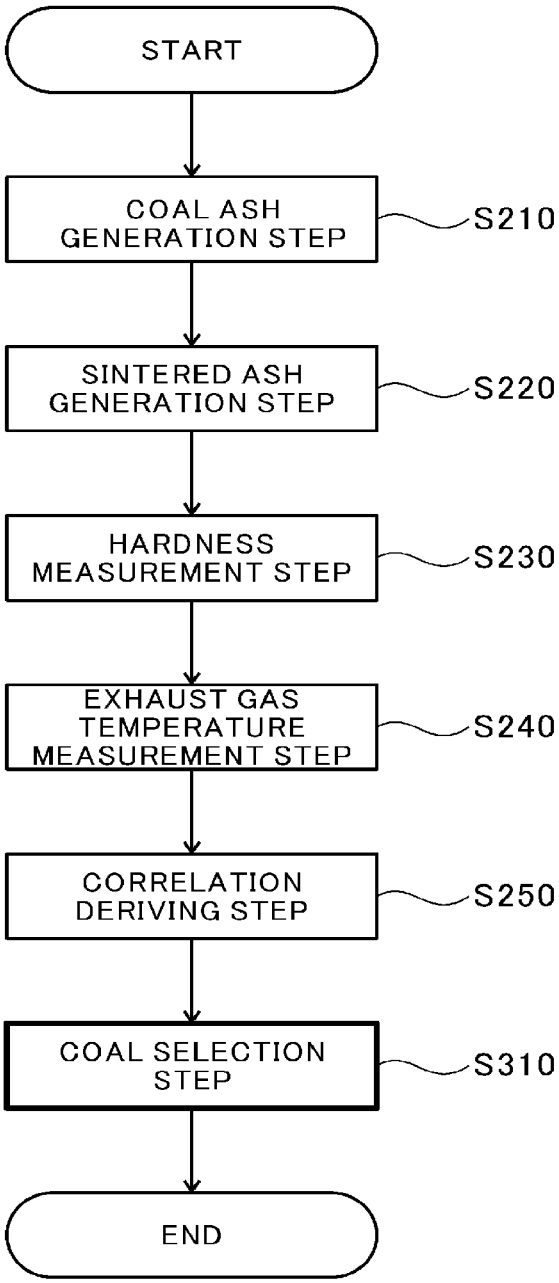
FIG. 6 is a flowchart for illustrating a flow of processing of a coal burning boiler ash adhesion prevention method in the second embodiment.

Next, a coal burning boiler ash adhesion prevention method using the coal burning boiler ash adhesion prevention device 300 is described. FIG. 6 is a flowchart for illustrating a flow of processing of the coal burning boiler ash adhesion prevention method in the second embodiment. As illustrated in FIG. 6, the coal burning boiler ash adhesion prevention method includes the coal ash generation step S210, the sintered ash generation step S220, the hardness measurement step S230, the exhaust gas temperature measurement step S240, the correlation deriving step S250, and a coal selection step S310. The processing steps that are substantially the same as those of the coal burning boiler ash adhesion estimation method are denoted by the same reference symbols, and the description thereof is omitted.

[Coal Selection Step S310]

The coal selection step S310 is performed at timing different from that of the coal ash generation step S210 to the correlation deriving step S250. For example, the coal ash generation step S210 to the correlation deriving step S250 are performed before the operation of the coal burning boiler 100, and the coal selection step S310 is performed during the operation of the coal burning boiler 100.

The coal selection step S310 is a step in which the coal selection module 364 selects, as fuel, coal having hardness at which the exhaust gas temperature becomes the above-mentioned set value or less with reference to the hardness data based on the correlation between the hardness and the exhaust gas temperature derived in the correlation deriving step S250.

As described above, the coal burning boiler ash adhesion prevention device 300 and the coal burning boiler ash adhesion prevention method using the same in this embodiment include the coal selection module 364. Through use of the coal selected by the coal selection module 364 as fuel, the exhaust gas temperature can be suppressed to the set value or less. Accordingly, the coal burning boiler ash adhesion prevention device 300 can suppress ash adhesion to the heat transfer tubes in the coal burning boiler 100 and reduce the inhibition of the heat exchange with the exhaust gas in the heat transfer tubes.

As a result, the coal burning boiler ash adhesion prevention device 300 can stably continue the operation of the actual coal burning boiler 100. For example, the coal burning boiler ash adhesion prevention device 300 can avoid damage of 100 million yen or more to the coal burning boiler 100 installed in a 600 MW class power plant by avoiding a forced stop caused by ash failure only once.

As described above, the coal burning boiler ash adhesion prevention device 300 and the coal burning boiler ash adhesion prevention method can suppress a decrease in operating rate of the coal burning boiler 100 caused by ash failure and effectively utilize economical low-quality coal by grasping the correlation between the hardness and the exhaust gas temperature in the same manner as in the coal burning boiler ash adhesion estimation device 200 and the coal burning boiler ash adhesion estimation method.

Third Embodiment: Coal Burning Boiler Operation Device 400

Figure 7:
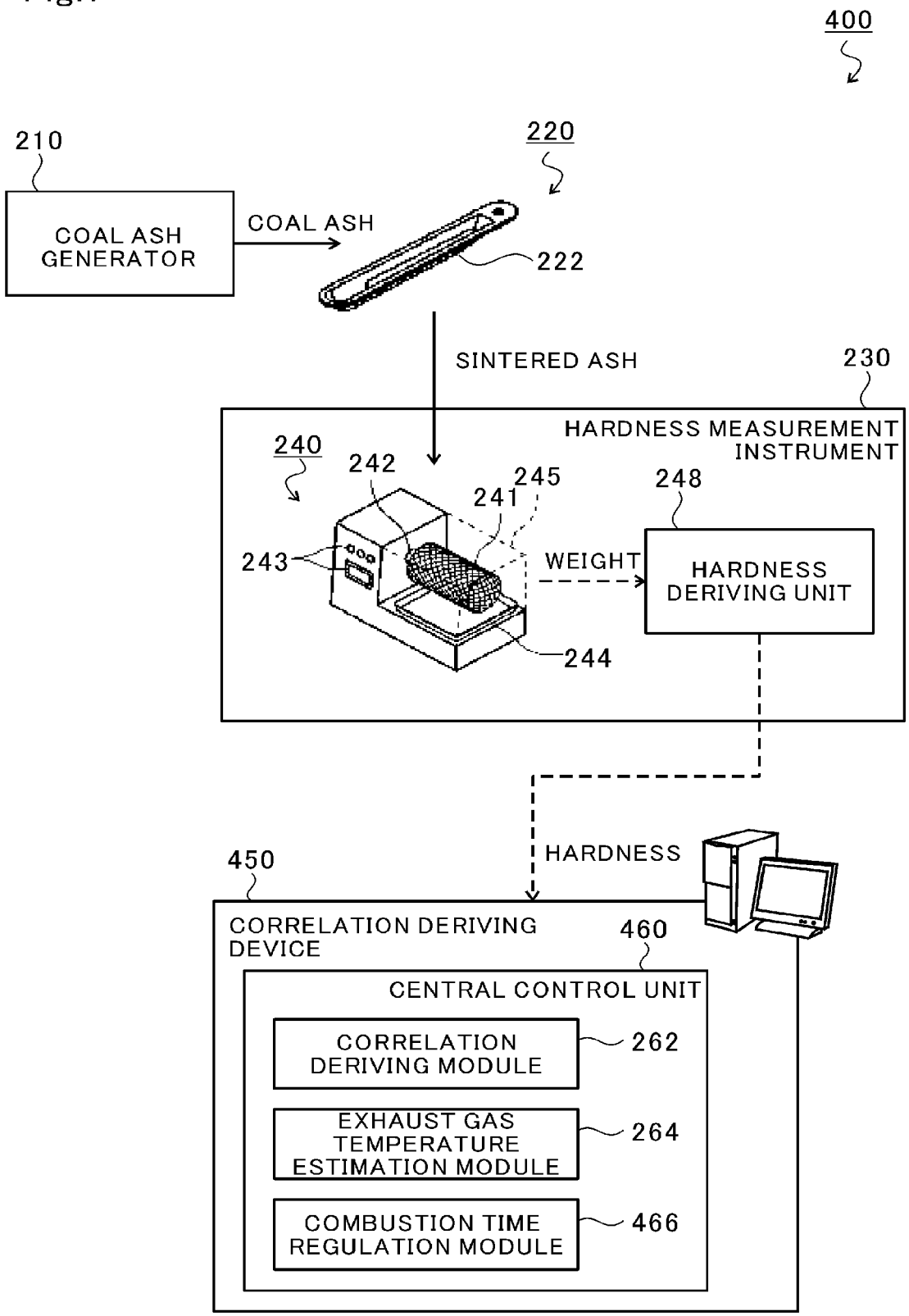
FIG. 7 is a diagram for illustrating a coal burning boiler operation device in a third embodiment of the present disclosure.

FIG. 7 is a diagram for illustrating a coal burning boiler operation device 400 in a third embodiment of the present disclosure. As illustrated in FIG. 7, the coal burning boiler operation device 400 includes the coal ash generator 210, the sintered ash generator 220, the hardness measurement instrument 230, and a correlation deriving device 450. The components that are substantially the same as those of the coal burning boiler ash adhesion estimation device 200 are denoted by the same reference symbols, and the description thereof is omitted.

The correlation deriving device 450 includes a central control unit 460. The central control unit 460 is formed of a semiconductor integrated circuit including a central processing unit (CPU). The central control unit 460 reads out a program, parameters, and the like for operating the CPU itself from a ROM. The central control unit 460 manages and controls the entire correlation deriving device 450 in cooperation with a RAM serving as a work area and other electronic circuits.

In this embodiment, the central control unit 460 functions as the correlation deriving module 262, the exhaust gas temperature estimation module 264, and a combustion time regulation module 466.

The combustion time regulation module 466 outputs a control signal to, for example, the burners 140 (see FIG. 1) based on the estimation value of the exhaust gas temperature derived by the exhaust gas temperature estimation module 264, and regulates the time for injection of pulverized coal fuel from the burners 140 to the inside of the furnace 120.

[Coal Burning Boiler Operation Method]

Figure 8:
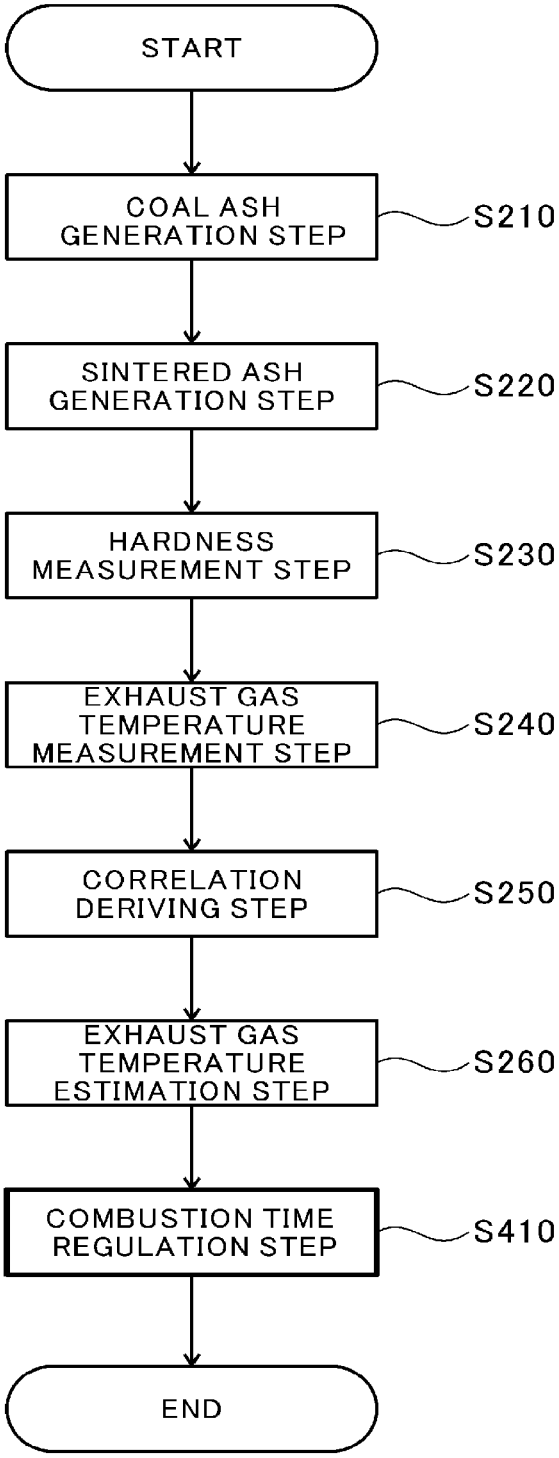
FIG. 8 a flowchart for illustrating a flow of processing of a coal burning boiler operation method in the third embodiment.

Next, a coal burning boiler operation method using the coal burning boiler operation device 400 is described. FIG. 8 is a flowchart for illustrating a flow of processing of the coal burning boiler operation method in the third embodiment. As illustrated in FIG. 8, the coal burning boiler operation method includes the coal ash generation step S210, the sintered ash generation step S220, the hardness measurement step S230, the exhaust gas temperature measurement step S240, the correlation deriving step S250, the exhaust gas temperature estimation step S260, and a combustion time regulation step S410. The processing steps that are substantially the same as those of the coal burning boiler ash adhesion estimation method are denoted by the same reference symbols, and the description thereof is omitted.

[Combustion Time Regulation Step S410]

The exhaust gas temperature estimation step S260 described above and the combustion time regulation step S410 are performed at timing different from that of the coal ash generation step S210 to the correlation deriving step S250. For example, the coal ash generation step S210 to the correlation deriving step S250 are performed before the operation of the coal burning boiler 100, and the exhaust gas temperature estimation step S260 and the combustion time regulation step S410 are performed during the operation of the coal burning boiler 100.

The combustion time regulation step S410 is a step in which the combustion time regulation module 466 regulates the combustion time of coal (time of supplying coal to the furnace 120) based on the estimation value of the exhaust gas temperature derived in the exhaust gas temperature estimation step S260.

For example, referring to the graph shown in FIG. 4, when the coal G, the coal H, or coal obtained by mixing the coal G and the coal H is used in the coal burning boiler 100, it is assumed that the hardness of the sintered ash becomes 0.5 or more, and the exhaust gas temperature exceeds 376° C. In such case, the combustion time regulation module 466 suppresses ash adhesion to the heat transfer tubes by setting the combustion time to be short. After that, the coal burning boiler 100 can be operated so as to switch the coal G, the coal H, or the coal obtained by mixing the coal G and the coal H to coal having hardness at which the exhaust gas temperature is decreased.

As a result, the coal burning boiler operation device 400 can stably continue the operation of the actual coal burning boiler 100 with improvement of economy by effectively utilizing low-quality coal while suppressing ash adhesion to the heat transfer tubes. For example, the coal burning boiler operation device 400 can reduce the annual cost by about 200 million yen when the fuel cost of the coal burning boiler 100 installed in the 600 MW class power plant is reduced by 1%.

As described above, the coal burning boiler operation device 400 and the coal burning boiler operation method can suppress a decrease in operating rate of the coal burning boiler 100 caused by ash failure and effectively utilize economical low-quality coal by grasping the correlation between the hardness and the exhaust gas temperature in the same manner as in the coal burning boiler ash adhesion estimation device 200 and the coal burning boiler ash adhesion estimation method and the coal burning boiler ash adhesion prevention device 300 and the coal burning boiler ash adhesion prevention method.

The embodiments have been described above with reference to the attached drawings, but it should be understood that the present disclosure is not limited to the above-mentioned embodiments. It is apparent that those skilled in the art may arrive at various alternation examples and modification examples within the scope of claims, and those examples are construed as naturally falling within the technical scope of the present disclosure.

For example, in the above-mentioned embodiments, as the hardness measurement instrument 230, the device including the rattler tester 240 has been given as an example. However, the hardness measurement instrument 230 may be a device for measuring compressive strength or a device for measuring Vickers hardness. When the hardness measurement instrument 230 is used as a device for measuring compressive strength or a device for measuring Vickers hardness, the hardness of the sintered ash can be easily measured. As the compressive strength [N/mm$^2$] or the Vickers hardness [HV] becomes larger, the hardness of the sintered ash becomes larger (sintered ash becomes harder).

In addition, the coal burning boiler 100, the coal burning boiler ash adhesion estimation device 200, the coal burning boiler ash adhesion prevention device 300, and the coal burning boiler operation device 400 in the above-mentioned embodiments each may use, as fuel, a single kind of coal or a mixture of a plurality of kinds of coals. It is more effective, from the viewpoint of improving economy of fuel cost, to mix bituminous coal, which is high-quality coal, with, for example, subbituminous coal, high silica coal, high S coal, high calcium coal, high ash coal, or the like, which is regarded as low-quality coal, as required and use the mixture as fuel.

In addition, in the above-mentioned first embodiment, the configuration in which the correlation deriving device 250 includes the exhaust gas temperature estimation module 264 and the adhesion estimation module 266 has been given as an example. However, it is only required that the correlation deriving device 250 include at least the correlation deriving module 262. Similarly, it is only required that the correlation deriving devices 350 and 450 include at least the correlation deriving module 262. As a result, the correlation deriving devices 250, 350, and 450 can derive the correlation between the hardness and the exhaust gas temperature, which is a new indicator regarding ash.

INDUSTRIAL APPLICABILITY

The present disclosure can be utilized in a correlation deriving method and a correlation deriving device.

What is claimed is:

1. A correlation deriving method, comprising the steps of:
   generating coal ash by incinerating coal;
   generating sintered ash by heating the coal ash at a predetermined heating temperature within a range of a combustion temperature of a coal burning boiler;
   measuring hardness of the sintered ash;
   measuring an exhaust gas temperature exhibited when coal which is to have the hardness is burnt in the coal burning boiler; and
   deriving a correlation between the hardness and the exhaust gas temperature.

2. A correlation deriving device, comprising a correlation deriving module configured to derive a correlation between: hardness of sintered ash obtained by heating coal ash at a predetermined heating temperature within a range of a combustion temperature of a coal burning boiler; and an exhaust gas temperature exhibited when coal which is to have the hardness is burnt in the coal burning boiler.

* * * * *